United States Patent [19]

Canto

[11] 3,954,499

[45] May 4, 1976

[54] METHOD AND APPARATUS FOR REMOVING DEW FROM A GREEN

[75] Inventor: Umberto Canto, Horsham, Pa.

[73] Assignee: Max Hankin, Horsham, Pa.

[22] Filed: Apr. 25, 1974

[21] Appl. No.: 464,125

[52] U.S. Cl. ..... 134/6; 15/104 R; 172/612; 273/32 R

[51] Int. Cl.[2] ..... B08B 7/00; A63B 71/00

[58] Field of Search ..... 134/6; 15/104 R, 210 R, 15/220 R, 104.3 R, 104.3 SN; 273/32 R; 401/289; 138/177; 172/612, 23; 111/7; 34/14

[56] References Cited

UNITED STATES PATENTS

| | | | |
|---|---|---|---|
| 1,448,505 | 3/1923 | Powers | 273/32 R |
| 1,524,421 | 1/1925 | Brady | 273/32 B |
| 1,748,354 | 2/1930 | Laing | 15/104 R |
| 2,701,559 | 2/1955 | Cooper | 15/104.3 SN |
| 2,739,585 | 3/1956 | Ayre | 15/104.3 SN |
| 2,825,983 | 3/1958 | Finn | 172/612 |
| 3,341,880 | 9/1967 | Young | 15/104.3 R |
| 3,359,591 | 12/1967 | McGuire | 15/210 R |
| 3,464,068 | 9/1969 | Whitaker | 134/6 |
| 3,542,137 | 11/1970 | Mai | 172/612 |
| 3,753,409 | 8/1973 | Frazier | 111/7 X |
| 3,825,443 | 7/1974 | Reilly | 134/8 |

*Primary Examiner*—Barry S. Richman
*Assistant Examiner*—Dale Lovercheck
*Attorney, Agent, or Firm*—Lerner, David, Littenberg & Samuel

[57] ABSTRACT

A method and apparatus for removing dew from various surfaces, such as golf greens, is disclosed. The apparatus includes a flexible elongated body, and means for maintaining a first end of the flexible body at a substantially fixed location on the surface as a second end of the flexible body is rotated about the first end. The method disclosed includes moving such a flexible elongated body across such surfaces in a direction transverse to the flexible body, while maintaining the body substantially in contact with the surface to be swept.

14 Claims, 2 Drawing Figures

METHOD AND APPARATUS FOR REMOVING DEW FROM A GREEN

FIELD OF THE INVENTION

The present invention relates to an apparatus for cleaning various surfaces, such as the grass surface of golf greens. More particularly, the present invention relates to an apparatus for removing dew from golf greens and other surfaces.

Still more particularly, the present invention relates to a method for cleaning surfaces such as grass, and golf greens.

BACKGROUND OF THE INVENTION

In the past when it has been desired to clean or otherwise manicure various surfaces, such as the grass surfaces comprising golf greens, it has been necessary to employ various time-consuming and energy-wasting devices, which have been employed manually by single individuals. Generally, these have included various green whips, which have been swung back and forth through the grass adjacent the ground and parallel thereto. Generally bamboo poles, or similar such devices, have been used. These poles or rods, however, aside from being very fragile, and wearing out and requiring replacement quite often, have also required the tiresome and lengthy whipping thereof back and forth across the surface manually, furthermore resulting in the nonuniform manicuring of these greens.

For example, U.S. Pat. No. 1,748,354 to Laing, teaches a metallic greens whip including a number of flexible metal rods of different lengths attached to a handle. The use of such a metallic whip for removing dew and worm-casts from golf greens, aside from being time-consuming and difficult, also results in substantial damage to the greens where careful manicuring is highly desirable.

U.S. Pat. No. 2,694,880, to Artese et al discloses a putting green sweeper including a pair of resilient snake wires attached to a handle, and coil springs thereabout, as well as means for maintaining the snake wires apart. Thus, again, the sweeper is whipped back and forth across the green, in a manner such as the bamboo poles previously employed. Again, this device suffers from all the above-noted deficiencies, including potentially serious damage to the greens.

U.S. Pat. No. 2,730,739, to Artese et al, discloses a sweeper including a number of elongated resilient strips and coil springs thereabout. The strips may thus be flexed in one direction only, in order to whip the green surface. Again, this device suffers from all of the deficiencies noted above. Furthermore, U.S. Pat. No. 1,524,421, to Brady, discloses a sand sand green scraper for golf links, including a blade and a clip carried thereon and adapted to engage the head of a golf club. This device is therefore used in the manner such as a normal broom, and therefore while it does not act as the whips described above, it is particularly slow and time consuming in use, and again results in nonuniform manicuring of such greens.

It is therefore an object of the present invention to provide a sweeper which overcomes these disadvantages of the prior art sweepers.

It is a further object of the present invention to provide a sweeper for cleaning various surfaces, such as golf greens, which is durable, can be easily employed by a single individual, and which results in the fast and tireless cleaning of such surfaces in highly uniform manner.

It is yet another object of the present invention to provide such sweepers which, while uniformly cleaning the surfaces, does not damage them in any way.

It is yet another object of the present invention to provide a method for sweeping such surfaces, such as golf greens, in a relatively short period of time, and without damaging the surfaces.

It is yet another object of the present invention to provide an apparatus and method for sweeping and cleaning such surfaces, such as golf greens, which can be accomplished from a vehicle, such as a golf cart, without requiring manual whipping or sweeping of the surfaces.

Other objects and advantages of the present invention will become apparent during the course of the following description.

SUMMARY OF THE INVENTION

In accordance with the present invention, a sweeper is provided, including a flexible elongated body, including a first and second end, and means for maintaining the first end of the flexible elongated body at a substantially fixed location on the surface to be scraped upon the rotation of the second end of the flexible elongated body about the first end.

In another embodiment of the present invention, it includes means for maintaining the central portion of the flexible elongated body substantially in contact with the surface to be swept upon the movement of the flexible elongated body in a direction transverse thereto across that surface.

In a preferred embodiment, the flexible elongated body includes means for attaching at least one end thereof to a vehicle, such as a golf cart.

In another embodiment of the present invention, a method for sweeping surfaces such as golf greens is provided, by moving a flexible elongated body across the surface to be swept in a direction transverse to the flexible elongated body, while the flexible elongated body is maintained in substantial contact with the surface to be swept.

In another embodiment of this invention, one end of the flexible elongated body is maintained in a substantially fixed location, while the other end of the flexible elongated body is rotated thereabout.

DETAILED DESCRIPTION

Figure 1:
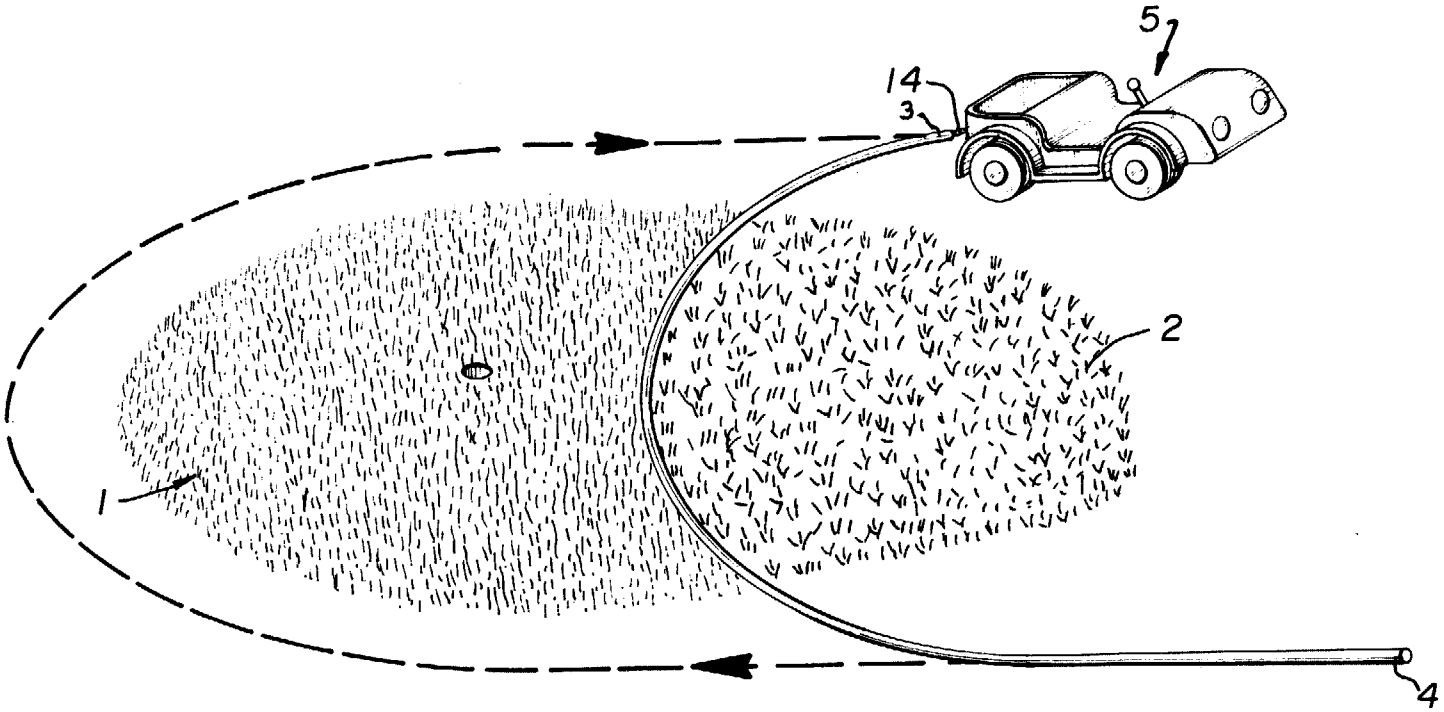
FIG. 1 is a perspective view of the method of using the sweeper of the present invention.

Referring to the drawings, in which like numerals refer to like elements therein, FIG. 1 shows the sweeper of the present invention being used to sweep the surface of a golf green 2 so as to remove the dew therefrom. As shown in FIG. 1, while the first end 3 of the sweeper may be moved manually, it is preferably carried by a vehicle, such as a golf cart 5, or by means of a tractor, or other such vehicle. When a golf green, which is generally circular in configuration, is to be swept, the second end 4 of the sweeper is placed at a location on the periphery of the green, but not upon the green's surface, and the first end 3 of the sweeper is rotated thereabout. This method of operation will be highly preferred, although it is also possible to place the second end of the sweeper substantially in the center of the green, such as at or near the cup, and rotate the first end of the sweeper thereabout, in a circular manner.

When it is preferred to sweep or clean such a surface, such as a golf green, in a single motion, both the first end 3 and the second end 4 of the sweeper 1 may be moved thereacross, in a direction transverse to the sweeper body 7, as will be described further hereinafter.

Figure 2:
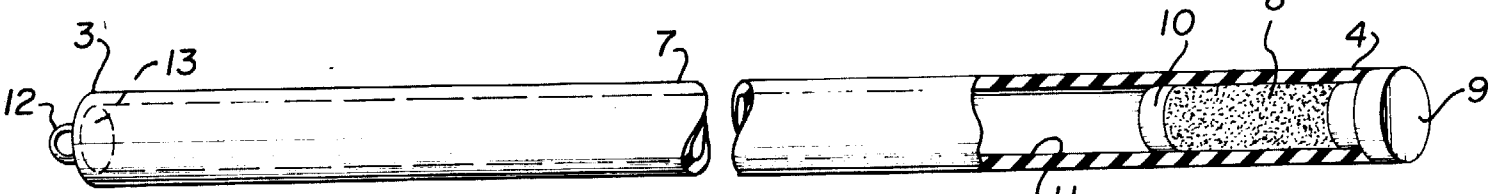
FIG. 2 is a plan view, partially cut-away, of a reduced sweeper of the present invention.

As can best be seen from FIG. 2, the sweeper itself includes an elongated body 7, which is preferably cylindrical in cross section, and of a substantial length, such as up to 100 feet or greater. Preferably, the body 7 itself will be flexible, comprising a material such as rubber, which will not damage the surface which is to be swept or cleaned. For example, a length of hose may form the sweeper body 7. In the embodiment shown in FIG. 2 means are provided for maintaining the second end 4 of the sweeper 1 substantially in contact with the surface to be swept upon rotation of the first end 3 of the sweeper 1 thereabout in the manner shown in FIG. 1. As shown, sand or other weight 8 is provided in the second end 4 of the body 7. In order to maintain this weight, such as sand 8, in the second end 4 of the sweeper, a pair of plugs 9 and 10 are provided. The first plug 9 is provided in the second end 4 of the sweeper body 7, both to provide added weight of its own, and to maintain the sand 8 therewithin. The first plug 9 may therefore be a heavy material, such as lead, in order to itself maintain the second end 4 of the sweeper body 7 against the surface to be cleaned. A second plug 10 is also provided within the sweeper body 7, and fitting snugly against the inner surface 11 thereof, in order to firmly maintain this sand 8 between the end of the hose 4, and the first plug 9, and the position of the second plug 10.

The first end 3 of the body 7 includes an eye hook 12 mounted on a plug 13 maintained in the end thereof. This may be accomplished by any suitable means, such as by providing a threaded end on the eye hook 12, and corresponding threads in the plug 13 at the first end 3 of the sweeper body 7.

In this manner, the eye hook 12 may be carried on a hook 14 attached to the vehicle such as golf cart 5, and cleaning or sweeping of the green or other surface does not have to be carried out manually, as has been the past practice.

In the preferred embodiment of this invention, two second or inner plugs 10 are provided within the sweeper body 7, in the manner described above, but within the central portion between the first end 3 and the second end 4 thereof. These inner plugs 10 will be spaced apart, and the weight, such as sand 8, will be provided therebetween. In this embodiment, a pair of eye hooks 12 are provided, at both ends 3 and 4 of the sweeper body 7, so that the ends of the sweeper body may both be carried by a pair of vehicles, such as golf carts 5, and the body therefore moved transversely across the surface to be cleaned, such as the fairway on a golf course. In this manner, such a surface may be swept in a single stroke, for maximum efficiency.

In operation, the weight, such as sand 8, or the plug 9 itself at the end thereof, maintains the sweeper body 7 substantially in contact with the surface to be swept, such as a golf green, as the sweeper body 7 is moved transversely across that surface, either by rotating the first end 3 in a substantially circular motion about the second end 4, or by moving both ends 3 and 4 simultaneously, where the weight 8 is preferably placed in the center of the sweeper body 7, between the first and second ends 3 and 4, respectively, thereof. Thus, in the former mode of operation, as specifically shown in FIG. 1, the second end 4 of the sweeper, containing the added weight is placed on the periphery of the green, and the first end 3 is attached to the golf cart 5 in the manner described above. The golf cart 5 then travels about the periphery of the green as shown by the dotted line in FIG. 1. In this manner the sweeper manicures the entire surface of the green, 1 and 2, upon one revolution of the golf cart 5 about its periphery, without the driver having to leave the golf cart 5 at any time. He may thus care for a large number of such greens in a very short period of time, without any damage to these easily disturbed green surfaces.

It is to be understood that the forms of my invention herewith shown and described are to be taken as preferred examples of the same and that various changes in the shape, size, and arrangement of parts may be resorted to without departure from the spirit of the invention of the scope of the appended claims.

I claim:

1. A sweeper for cleaning dew off of the surface of a golf green comprising, a flexible elongated body, said body including a first end and a second end; and means for maintaining said second end of said flexible elongated body at a substantially fixed location relative to said surface of said golf green upon the rotation of said first end of said flexible elongated body about said second end, said flexible elongated body being hollow, and including a substantially smooth outer surface so that said golf green is not damaged by the movement of said flexible elongated body across its surface, said means further comprising a weight mounted within the second end of said flexible elongated body, and at least one plug means located within said hollow flexible elongated body, the outside diameter of said plug means substantially coinciding with the inside diameter of said flexible elongated body so as to close off said flexible elongated body and maintain said weight means at a fixed location therein, so that said weight and said plug means do not interfere with the substantially smooth surface thereof.

2. The sweeper of claim 1, including means for attaching said first end of said flexible elongated body to a vehicle.

3. The sweeper of claim 2 wherein said means for attaching said flexible elongated body to a vehicle comprises an eye hook.

4. The sweeper of claim 1 wherein said flexible elongated body has a substantially cylindrical cross section.

5. The sweeper of claim 4 wherein said flexible elongated body comprises rubber.

6. A sweeper for cleaning dew off of the surface of golf greens comprising, a flexible elongated body, said body including a first end, a second end, and a central portion, means for maintaining said central portion of said flexible elongated body substantially in contact with said surface of said golf green upon the transverse movement of said first end and said second end of said flexible elongated body across said surface of said golf green, said flexible elongated body being hollow and said means for maintaining said central portion of said flexible elongated body comprising weight means maintained within the hollow central portion of said flexible elongated body, said flexible elongated body further including a substantially smooth outer surface so that upon its transverse movement across the surface of said golf green said surface is not damaged thereby, and a pair of plugs maintained within said flexible elongated body on either side of said weight means, said plugs having an outer diameter which substantially coincides with the inner diameter of said flexible elongated body, so as to substantially close off the inside of said flexible elongated body and maintain said weight means at a fixed location therein.

7. The sweeper of claim 6 including means for attaching said first end and said second end of said flexible elongated body to vehicles.

8. The sweeper of claim 6 wherein said flexible elongated body has a substantially cylindrical cross section.

9. The sweeper of claim 7 wherein said means for attaching said first and second ends to said vehicle comprises eye hooks.

10. A method for sweeping dew off of the surface of a golf green without damaging said surface, comprising moving a flexible elongated hollow body including a first end and a second end across said surface of said golf green in a direction transverse to said flexible elongated body, while maintaining said flexible elongated body substantially in contact with said surface of said golf green, said second end of said flexible elongated body being maintained in a substantially fixed location relative to said surface of said golf green by means comprising a weight mounted within the second end of said flexible elongated body, and at least one plug means located within said hollow flexible elongated body, the outside diameter of said plug means substantially coinciding with the inside diameter of said body so as to close off said flexible elongated body and maintain said weight means at a fixed location therein, and furthermore said flexible elongated body including a substantially smooth outer surface so that upon the transverse movement of said flexible elongated body across the surface of said golf green said surface is not damaged thereby.

11. The method of claim 10 wherein said flexible elongated body includes a central portion, and wherein said central portion includes weight means within said flexible elongated body for maintaining said central portion substantially in contact with said surface, without interfering with the substantially smooth outer surface of said flexible elongated body.

12. The method of claim 10 wherein said flexible elongated body has a substantially cylindrical cross section.

13. The method of claim 10 wherein said flexible elongated body comprises rubber.

14. The method of claim 10 wherein said flexible elongated body is moved in said transverse direction by attaching at least one end of said flexible elongated body to a vehicle, and moving said vehicle in a direction transverse to said flexible elongated body.

* * * * *